US008537056B2

(12) United States Patent
Ho

(10) Patent No.: US 8,537,056 B2
(45) Date of Patent: Sep. 17, 2013

(54) ANTENNA AND PORTABLE DEVICE EMPLOYING THE SAME

(75) Inventor: Chin-Lung Ho, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 404 days.

(21) Appl. No.: 12/910,845

(22) Filed: Oct. 24, 2010

(65) Prior Publication Data

US 2012/0075146 A1 Mar. 29, 2012

(51) Int. Cl.
*H01Q 1/24* (2006.01)

(52) U.S. Cl.
USPC ..... 343/702; 343/700 MS

(58) Field of Classification Search
USPC ..... 343/702, 700 MS, 846
See application file for complete search history.

(56) References Cited

U.S. PATENT DOCUMENTS

| | | | | |
|---|---|---|---|---|
| 7,061,437 | B2 * | 6/2006 | Lin et al. | 343/702 |
| 8,212,727 | B2 * | 7/2012 | Hsu | 343/702 |
| 2005/0184914 | A1 * | 8/2005 | Ollikainen et al. | 343/702 |
| 2007/0268189 | A1 * | 11/2007 | Kuramoto et al. | 343/700 MS |
| 2008/0129637 | A1 * | 6/2008 | Chi et al. | 343/866 |
| 2010/0097272 | A1 * | 4/2010 | Kim et al. | 343/700 MS |
| 2011/0128195 | A1 * | 6/2011 | Ryou et al. | 343/702 |

* cited by examiner

*Primary Examiner* — Hoanganh Le
(74) *Attorney, Agent, or Firm* — Altis Law Group, Inc.

(57) ABSTRACT

A portable device includes a main body and an antenna mounted on the main body. The main body includes a printed circuit board (PCB). A first guide pole and a second guide pole are configured on the PCB. The antenna includes a first conductor portion, a second conductor portion and an insulated portion. The first conductor portion includes a first connecting end electrically connected to the PCB via the first guide pole. The first connecting end acts as a feed portion of the antenna. The second conductor portion is disposed between the first conductor portion and the PCB and includes a second connecting end electrically connected to the PCB via the second guide pole. The insulated portion is sandwiched between the first conductor portion and the second conductor portion to insulate the first conductor portion from the second conductor portion.

9 Claims, 4 Drawing Sheets

ANTENNA AND PORTABLE DEVICE EMPLOYING THE SAME

BACKGROUND

1. Technical Field

The present disclosure relates to a portable device, and more particularly to an antenna of the portable device.

2. Description of Related Art

In generally, a wire is used as an antenna and disposed around a liquid crystal module (LCM) of a portable device. However, the wire must be soldered to a printed circuit board (PCB) of the portable device making it difficult for the portable device to be mass produced.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
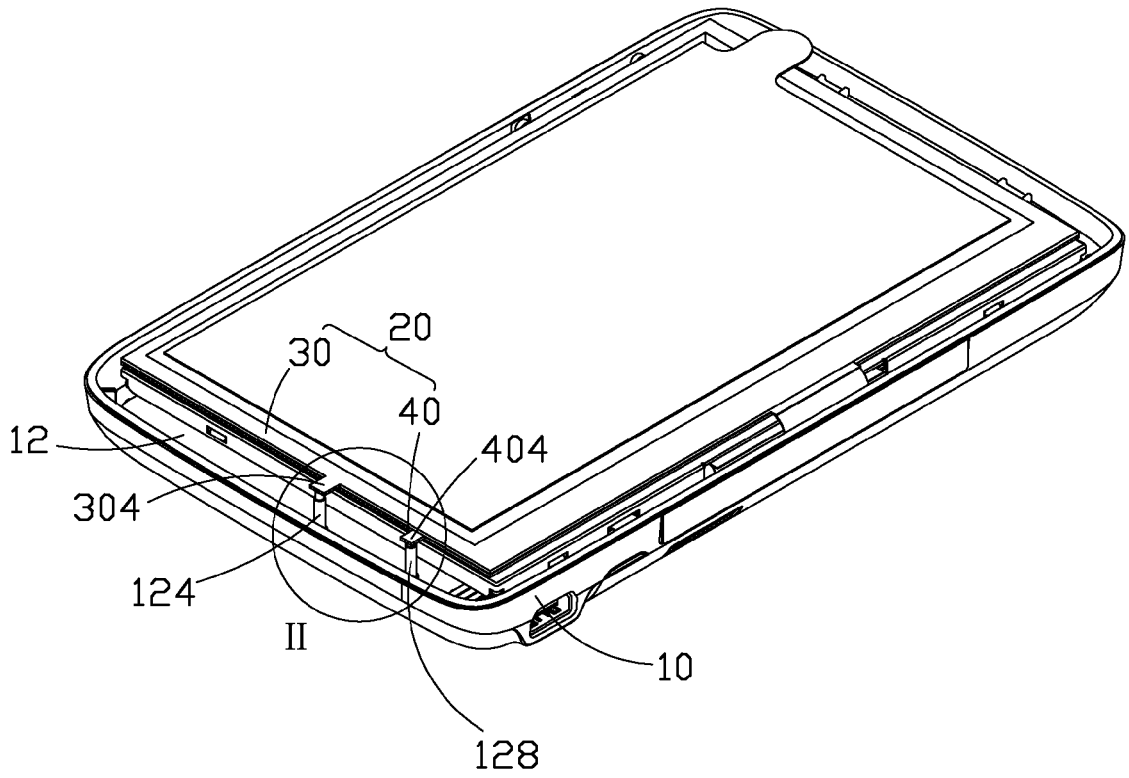
FIG. 1 is an isometric view of a portable device according to the present disclosure.
Figure 2:
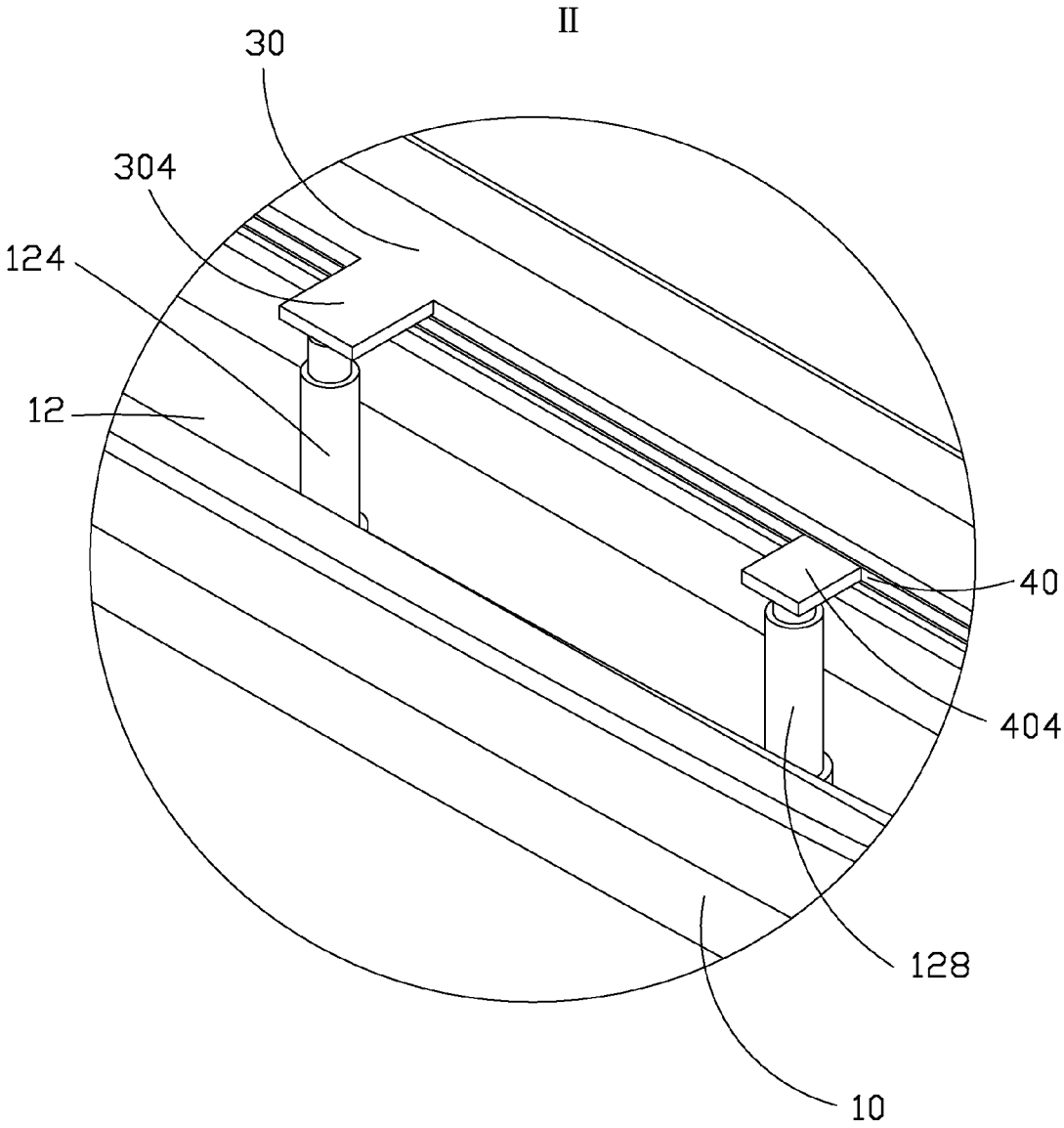
FIG. 2 is an enlarged view of part II of FIG. 1 according to the present disclosure.

Referring to FIG. 1 and FIG. 2, a portable device comprises a main body 10 and an antenna 20 mounted on the main body 10. The main body 10 comprises a printed circuit board (PCB) 12. A first guide pole 124 and a second guide pole 128 are configured on the PCB 12. In the illustrated embodiment, the first guide pole 124 and the second guide pole 128 are both vertical with respect to the PCB 12.

Figure 3:
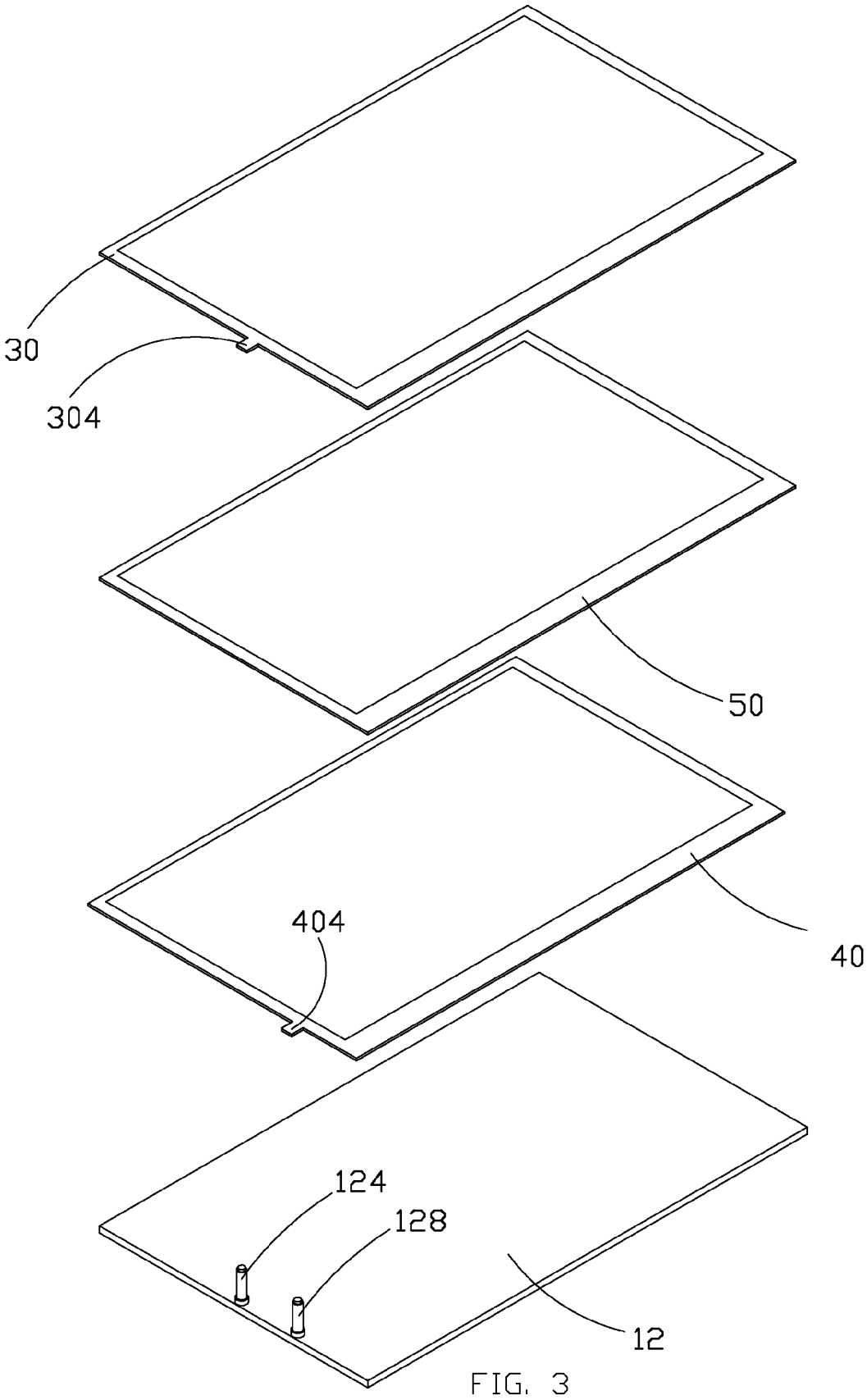
FIG. 3 is a disassembled perspective view of a printed circuit board and an antenna according to the present disclosure.
Figure 4:
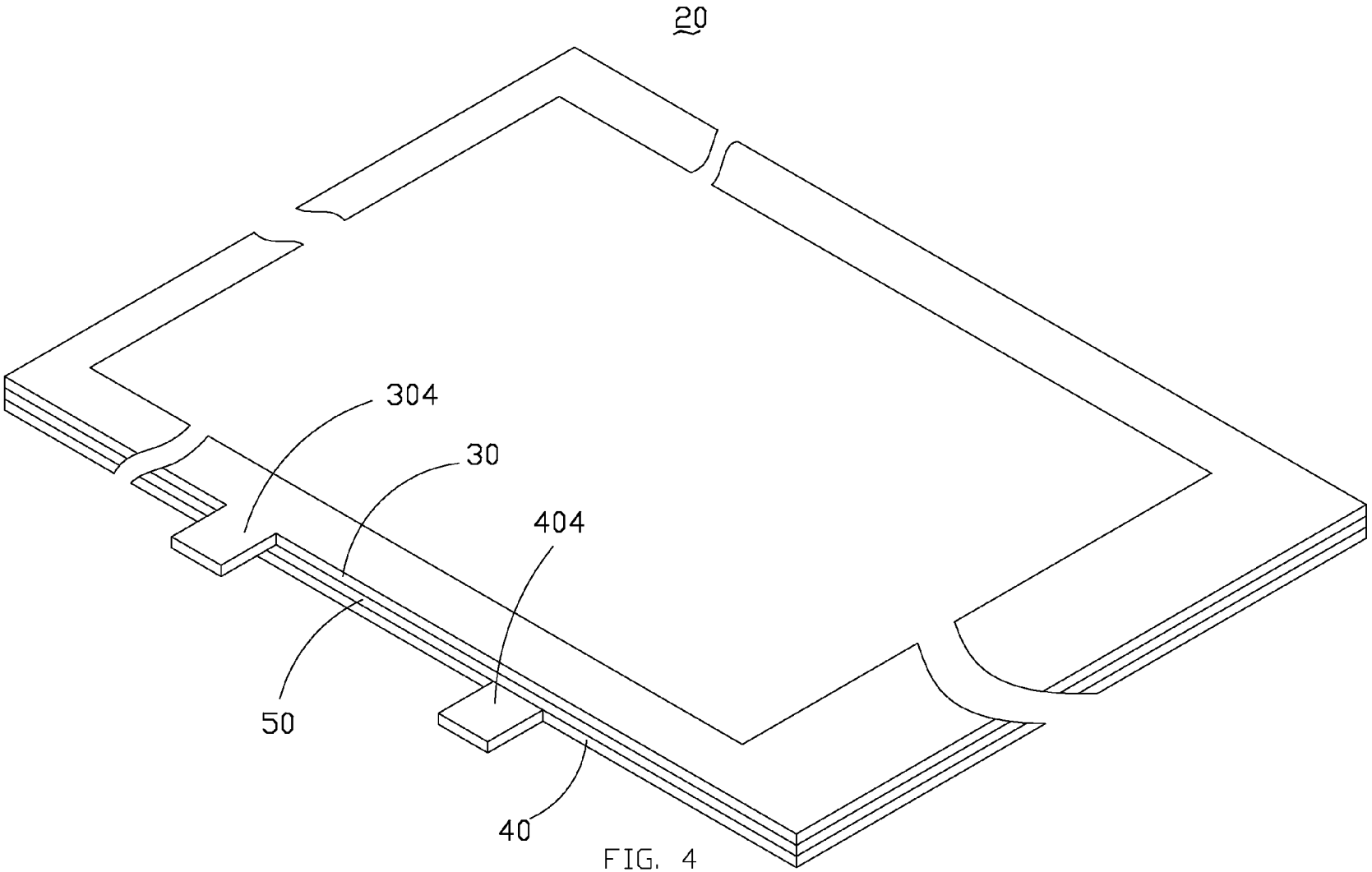
FIG. 4 is a perspective view of the antenna according to the present disclosure.

In the illustrated embodiment, the antenna 20 is mounted around a display screen (not shown) of the portable device. Referred to FIG. 3 and FIG. 4, the antenna 20 is configured in a shape of a hollow rectangle. The antenna 20 comprises a first conductor portion 30, a second conductor portion 40 and an insulated portion 50. In the illustrated embodiment, the first conductor portion 30 and the second conductor portion 40 are made of a metal material. The first conductor portion 30 comprises a first connecting end 304 electrically connected to the PCB 12 via the first guide pole 124. The first connecting end 304 protrudes outwardly from the first conductor portion 30 and acts as a feed portion of the antenna 20. Therefore, the first conductor portion 30 can receive communication signals and have the function of capacitance induction. The second conductor portion 40 is disposed between the first conductor portion 30 and the PCB 12 to shield electromagnetic interference (EMI) from electronic elements on the PCB 12. The second conductor portion 40 can protect the first conductor portion 30 from EMI and comprises a second connecting end 404 electrically connected to the PCB 12 via the second guide pole 128. The second connecting end 404 protrudes outwardly from the second conductor portion 40 and acts as a contact point of the antenna 20. The second conductor portion 40 is used to protect the antenna 20 from interference signals generated by electronic elements on the PCB 12. The interference signals can affect the antenna 20 to transceive communication signals and affect the capacitance induction of the antenna 20. In the illustrated embodiment, the first connecting end 304 and the second connecting end 404 have the same shape. The insulated portion 50 is sandwiched between the first conductor portion 30 and the second conductor portion 40 to insulate the first conductor portion 30 from the second conductor portion 40. In the illustrated embodiment, the insulated portion 50 is made of sponge.

In the other illustrated embodiment, another insulated portion 50 is stacked to a side of the second conductor portion 40 nearing the PCB 12 to prevent the second conductor portion 40 touching with a metal outline border of the display screen directly.

In assembly, the insulated portion 50 is mounted between the first conductor portion 30 and the second conductor portion 40. The first connecting end 304 and the second connecting end 404 are disposed on the same side of the antenna 20 and spaced from each other. The first connecting end 304 and the second connecting end 404 are connected electronically with the first guide pole 124 and the second guide pole 128 to form a feed portion and a contact point of the antenna 20, respectively. The communication frequency and the induction capability of the antenna 20 can be changed by changing the space between the first connecting end 304 and the second connecting end 404.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An antenna, comprising:

a first conductor portion configured in the shape of a hollow rectangle, and comprising a first connecting end protruding outwardly from the first conductor portion and acting as a feed portion of the antenna;

a second conductor portion configured in the shape of a hollow rectangle, and comprising a second connecting end protruding outwardly from the second conductor portion and acting as a contact point of the antenna; and an insulated portion, sandwiched between the first conductor portion and the second conductor portion to insulate the first conductor portion from the second conductor portion;

wherein the first connecting end and the second connecting end are disposed on the same side of the antenna and spaced from each other.

2. The antenna as claimed in claim 1, wherein the first conductor portion and the second conductor portion are made of a metal material.

3. The antenna as claimed in claim 1, wherein the insulated portion is made of sponge.

4. The antenna as claimed in claim 1, wherein the insulated portion is configured in the shape of a hollow rectangle.

5. A portable device, comprising:

a main body, the main body comprising a printed circuit board (PCB), a first guide pole and a second guide pole configured on the PCB; and an antenna, the antenna mounted on the main body and comprising:

a first conductor portion configured in the shape of a hollow rectangle, and comprising a first connecting end protruding outwardly from the first conductor portion and electrically connected to the PCB via the first guide pole, wherein the first connecting end acts as a feed portion of the antenna;

a second conductor portion configured in a shape of a hollow rectangle, disposed between the first conductor portion and the PCB, and comprising a second connecting end protruding outwardly from the second conductor portion and electrically connected to the PCB via the second guide pole; and an insulated portion, sandwiched between the first conductor portion and the second conductor portion to insulate the first conductor portion from the second conductor portion.

6. The portable device as claimed in claim 5, wherein the first guide pole and the second guide pole are both vertical with respect to the PCB.

7. The portable device as claimed in claim 5, wherein the first conductor portion and the second conductor portion are made of metal material.

8. The portable device as claimed in claim 5, wherein the insulated portion is made of sponge.

9. The portable device as claimed in claim 5, wherein the insulated portion of the antenna is configured in the shape of a hollow rectangle.

* * * * *